US005239282A

United States Patent [19]

Filomia

[11] Patent Number: 5,239,282

[45] Date of Patent: Aug. 24, 1993

[54] ELECTRICAL BLADE FUSE

[75] Inventor: Domingo R. Filomia, San Andrés, Argentina

[73] Assignee: AMP Incorporated, Harrisburg, Pa.

[21] Appl. No.: 932,413

[22] Filed: Aug. 19, 1992

[30] Foreign Application Priority Data

Oct. 9, 1991 [AR] Argentina ..... 320886

[51] Int. Cl.[5] ..... H01H 85/22

[52] U.S. Cl. ..... 337/255; 337/260

[58] Field of Search ..... 337/255, 260, 264, 265, 337/266

[56] References Cited

U.S. PATENT DOCUMENTS

| | | | |
|---|---|---|---|
| 3,871,738 | 3/1975 | Dechelette | 339/256 C |
| 3,876,278 | 4/1975 | Battaglia et al. | 339/256 R |
| 4,202,589 | 5/1980 | Reavis, Jr. et al. | 339/97 R |
| 4,214,223 | 7/1980 | Kourimsky | 337/293 |
| 4,224,592 | 9/1980 | Urani et al. | 337/260 |
| 4,409,582 | 10/1983 | Kimmel et al. | 337/231 |
| 4,998,086 | 3/1991 | Kourimsky et al. | 337/255 |

FOREIGN PATENT DOCUMENTS

| | | | |
|---|---|---|---|
| 0259926 | 3/1988 | European Pat. Off. . | |
| 2940607 | 4/1981 | Fed. Rep. of Germany | 337/255 |

*Primary Examiner*—Harold Broome

*Attorney, Agent, or Firm*—Bruce J. Wolstoncroft

[57] ABSTRACT

The electrical blade fuse is sealed at both the bottom and the top so that the fuse material, once melted, cannot become dislodged to short out other electrical circuits or to short out the terminals of the fuse itself. A cap of the fuse encloses the fuse cavity and is maintained in position by utilizing tab portions of the fuse terminals which are deformed to hold the cap in place, and additionally to serve as test electrodes to allow testing of the fuse in place.

6 Claims, 2 Drawing Sheets

ELECTRICAL BLADE FUSE

FIELD OF THE INVENTION

This invention relates to an electrical blade fuse and particularly to a type of fuse utilized in automotive applications.

BACKGROUND OF THE INVENTION

In U.S. Pat. No. 4,998,086 issued Mar. 5, 1991, an electrical fuse assembly is taught which has a dielectric housing and fuse terminal, stamped and formed from metal stock having appropriate electrical characteristics. The assembly has a plastic housing which supports and holds terminal portions of the fuse in a position for engagement in a fuse block through terminals retained therein and further includes an integral positioning bar allowing the terminal to be properly positioned and held within the housing. The housing of this patent is shown to be open. Dependent upon the attitude of the fuse assembly in position in use, melted metal from the fuse, following an overload and fuse action, may fall from the housing and be deposited or become lodged between electrical circuits to cause shorting. In certain other fuse constructions, the bottom of the fuse may be open, allowing melted fuse material to fall or become lodged between the fuse terminals to result in a fuse malfunction and continuing conduction of current between fuse terminals.

SUMMARY OF THE INVENTION

Accordingly, it is an object of the present invention to provide an electrical blade fuse which is sealed at both bottom and top so that fuse material, once melted, cannot become dislodged to short out other electrical circuits or to short out the terminals of the fuse itself. It is a further object to provide an electrical blade fuse, housing and terminals allowing for automatic assembly through assembly displacement which is along a common axis. It is still a further object to provide a fuse having a cap enclosing the fuse cavity by utilizing tab portions of the fuse terminals deformed to hold such cap in place and additionally to serve as test electrodes to allow testing of the fuse in place.

The foregoing problems and the objectives of the invention are met through the provision of an electrical blade fuse having a plastic housing with an interior opening of a volume sufficient to readily accommodate melted fuse material without shorting between the terminals, regardless of the attitude of the fuse at the moment of material melting. The housing includes a cap which fits over such opening and which is held in place by tab portions integral with a terminal mounted in the housing, which tab portions are folded over the cap to retain such to the fuse housing. The terminal of the assembly is a one-piece stamped and formed element having a fuse portion of a resistivity and cross-sectional dimension to be heated up by particular current through $I^2R$ heating in the presence of a current I causing the fuse material to melt and separate a pair of terminals which include post blade portions extending from the housing. The blade portions are inserted as terminals within receptacle portions of a circuit being protected by the fuse. An example would be the fuse block arrangement in an automobile wherein the fuses protect the wiring circuit of the vehicle from overloads. Automotive lamp circuits, heater circuits, and electronic devices are typically protected by such fuses.

The terminal is formed of one piece as by stamping to include latch elements which engage the housing of the fuse assembly and latch the terminals in place within such housing against displacement out of such housing. The tab portions formed on the terminals are inserted through the cap and folded to preclude displacement of the cap itself and, in turn, serve as probe points or electrodes for testing of the fuse in place and in use. In this way, the fuse assembly is essentially enclosed so that melted fuse material cannot escape from the interior of the housing.

DETAILED DESCRIPTION OF THE INVENTION

Figure 1:
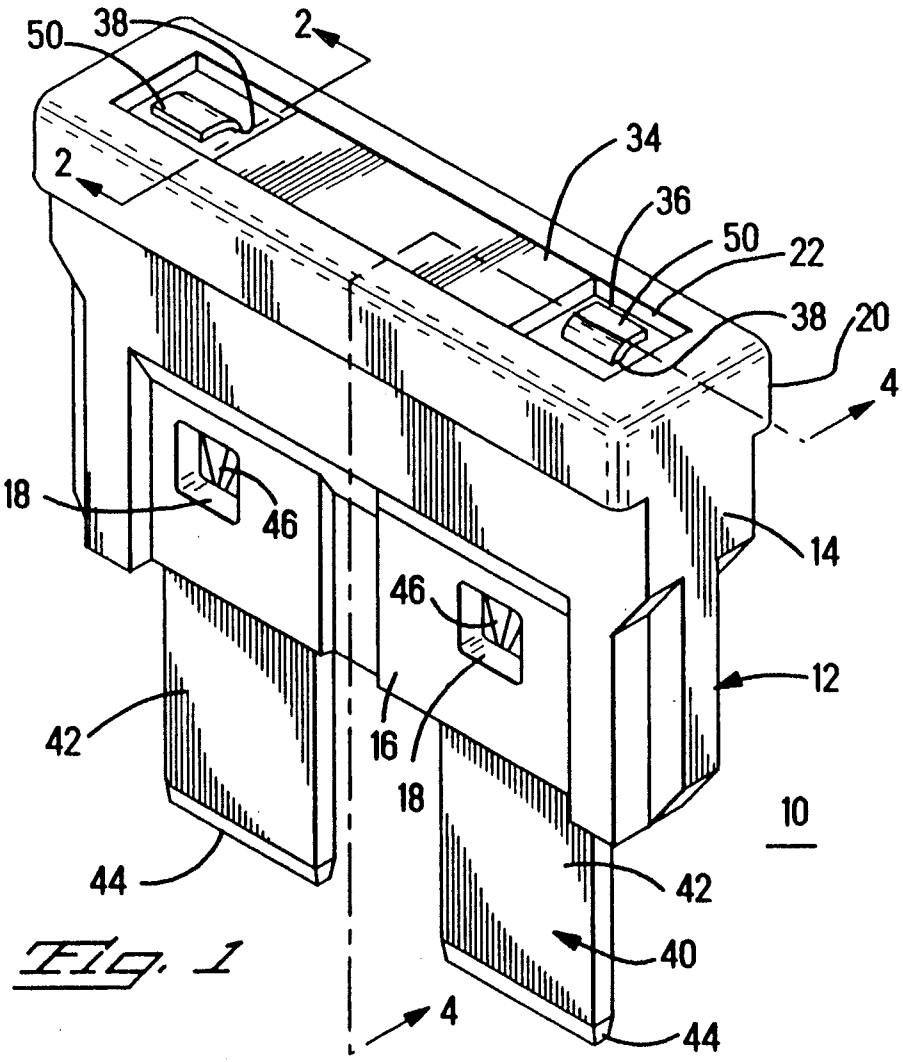
FIG. 1 is a perspective, substantially enlarged, of the fuse assembly of the invention.
Figure 4:
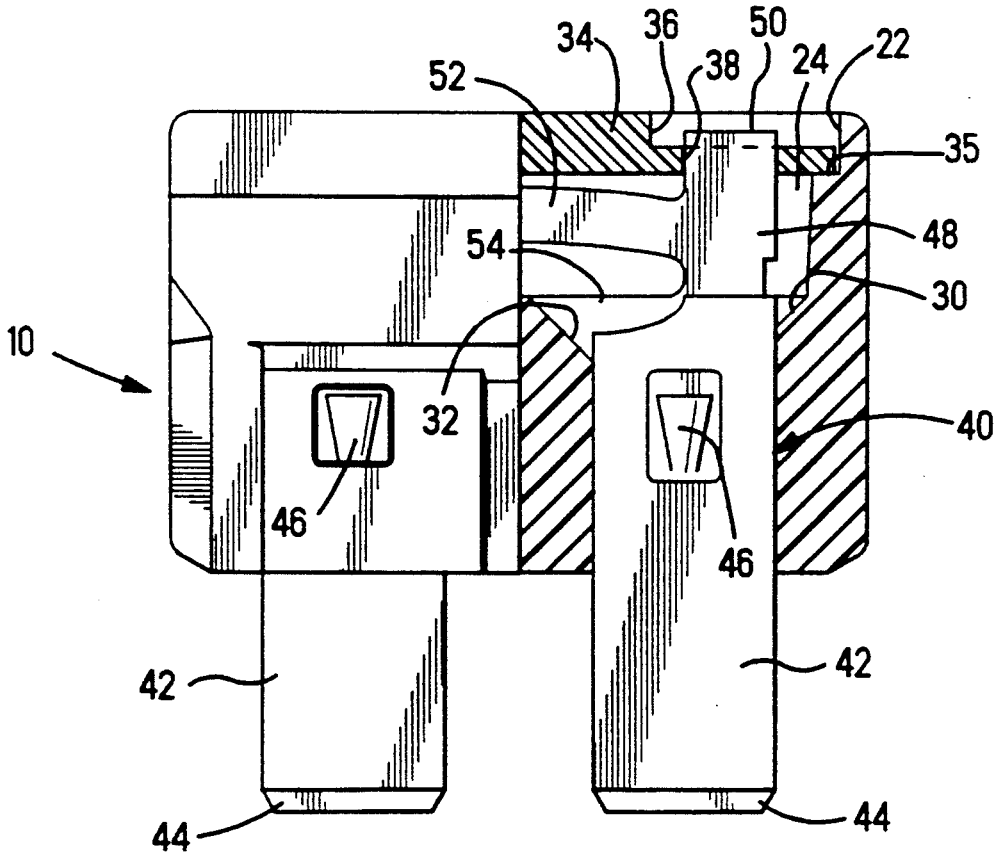
FIG. 4 is a side elevational view, partially sectioned, of the fuse as shown in FIGS. 1–3.

Referring to FIG. 1, a fuse assembly 10, in accordance with the present invention, is shown to include a housing 12 and a cap 34, both of plastic insulating material and further, a fuse 40 which includes a pair of blades 42 projecting from the housing and a fuse length portion 52 extending between the blades 42 in the manner shown in FIG. 4. The housing 12 includes an upper portion 14, as shown in FIG. 1, a lower portion 16 apertured as at 18, to receive latches of the terminal holding the terminal in place within the housing. An upper projecting portion 20 is provided which facilitates handling of the fuse during insertion of the fuse or withdrawal of a fuse relative to a fuse block. The fuse block, not shown, would include accommodation for numbers of fuses like 10 and would include further receptacles which receive the blade portions 42 of the projecting terminals and interconnect the fuse, typically in series with a wiring circuit connected to a load. The purpose of the fuse is to regulate the current flowing through such circuit, interrupting such circuit and the current when such current is excessive. In this way, the circuit may be protected from current overloads and the resulting damage including fire avoided thereby.

Figure 2:
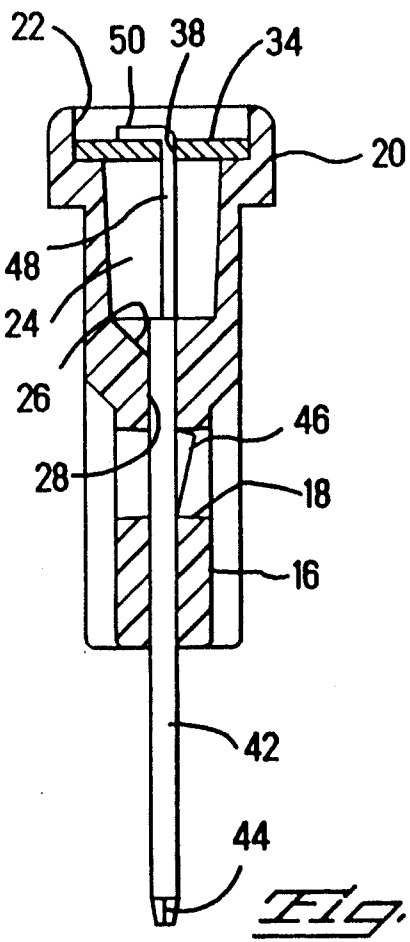
FIG. 2 is a side elevation, partially sectioned, of the assembly shown in FIG. 1.

FIG. 2 shows the top portion of the housing 20 to include a recess 22 which leads to an interior cavity 24 having sloped side walls 26 which lead to apertures 28 extending through the lower portion 16 of the housing to accommodate the terminal 40 and the blades 42 thereof. As can be seen, the apertures 28 are dimensioned to tightly fit against the outside surfaces of the fuse blades 42; note also the showing in FIG. 4 relative to the sides of the terminals being tightly engaged by the plastic material of the housing. Note in FIG. 4 that the ends of the cavities 24 are sloped as at 30 and 32 with the sloped surfaces of 26 facilitating assembly of the terminals 40 into the housings 12. These sloped surfaces further define a volume interiorly of the housing which further accommodates melted material from fuse length portion 52 of the terminal.

A cover or cap 34 is provided as shown in FIGS. 1, 2, and 4 which is made to fit snugly down inside cavity 22 to cover and effectively seal the interior cavity 24.

Figure 3:
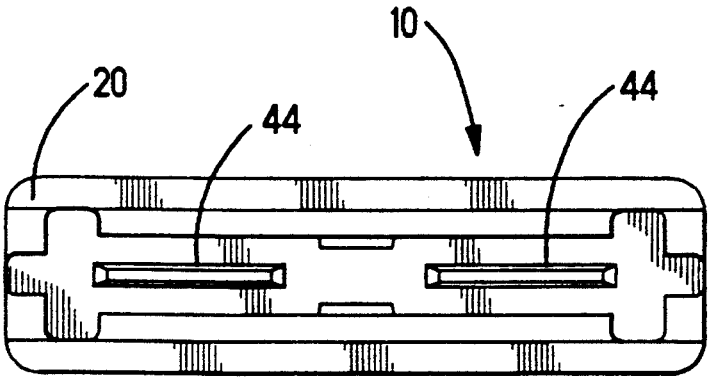
FIG. 3 is a view from the bottom of the fuse assembly shown in FIG. 2.

As can be seen in FIG. 4, the ends of the cover 34 rest upon a ledge shown as 35 which precludes inward displacement of the covers relative to the housing. As shown in FIGS. 1, 2, and 4 also, the covers 34 have recesses at the end shown as 36 and centered in such recesses, apertures 38 through which can be fitted tab portions of the terminal. As can be discerned from FIGS. 1, 2, and 4, the terminals 40 include, at the lower ends, blade portions 42 which are beveled as at 44 to facilitate insertion of the blade portions into receptacle portions of mating contacts not shown. As also can be discerned through FIGS. 2, 3, and 4, the terminals are formed of an integral metal stamping with the blade portions made sufficiently strong by folding of such material to effectively double the thickness of the blade portions 42 relative to the thickness of the stock from which the terminals are made. Latches 46 are provided extending out from portions 42 to engage apertures 18. The folded edge of the terminal portions is to the outside of each blade. As can be seen in FIGS. 2 and 4, the upper portion of each terminal includes a portion 48 which has extending therefrom a portion 50 forming the tab portion of the terminal. Both figures, as well as FIG. 1, show the tab portions 50 folded down against the cap portion, extended through the apertures 38 therein to retain the caps in a downward position within the housing. As can be seen from FIGS. 2 and 4, the tab portions are recessed in the cavities 36 so as to not protrude from the profile of the overall housing. This prevents the terminals from being shorted out by any conductive material coming against the housing. The tab portions 50, by extending through the cap material, allow testing of the fuse in place by electrodes of a multimeter or the like, placed against the tab portions 50 of each terminal portion.

As can be appreciated from FIGS. 2 and 4, the terminals can be straightforwardly loaded along a given axis parallel to the blade portions through the apertures 28 into place within the housings, the latches 46 struck from the material of the terminals feeding into the apertures 18 and latching therein against the upper surfaces thereof in the manner shown in FIG. 2.

Extending from the upper portions 48 of the terminals transversely between terminal blade portions is a thermal fuse length portion 52 which is given a resistance by virtue of the characteristics of the material of which the fuse metal is made in conjunction with a cross-section of portion 52 to define a precise R. This will yield a precise heating characteristic in the face of the current I to generate a melting of portion 52 in the presence of sufficient $I^2R$ energy caused essentially by the size of I. In accordance with the invention, a further projection beneath the length 52 and shown as 54 extends from each fuse portion 48 to fit within the housing and solidify the positioning of the terminals therewithin, particularly after the fuse length 52 which joins the two blades is no longer present due to having melted. Upon such melting, the blade portions of the fuse are held relatively rigidly with respect to the housings 12 by virtue of the latches 46, the projections 54 and the tab portions 50 held within the cap 34. The material from 52 typically melts and separates to form a blob of material attached to each terminal and residing in the volume proximate the upper end of the terminal, such volume defined by cavity 54 and the various surfaces 26, 30, and 32. In the event of displacement of material caused by sudden rupturing of portion 52, no material will escape from the volume of 24 due to the presence of the cap on the upper end of the housing and due to the presence of the tight fit of the lower portion of the housing 16 as described. Separated fuse material, if any such exists, will be retained inside the housing, regardless of the altitude of the fuse at the time when the fuse rupture occurs.

Having described the invention in terms intended to enable a preferred practice thereof, claims are set forth intended to define what is inventive.

In the claims:

1. An electrical blade fuse including an insulating housing having an inner cavity leading to a pair of lower apertures and a common upper opening, a cover receiving recess positioned adjacent the inner cavity, the cover receiving recess having an inner peripheral surface, a terminal element fitted in said cavity including a pair of terminal members with each member extending through one of the lower cavities, said members connected together by a fuse length portion of a cross-section to provide a precise resistance to melt at a precise temperature associated with a given current through heating, the said element including a pair of tabs extending oppositely to said terminal members integral with said terminal members and fuse portion, an insulating cover received within the cover receiving recess, the insulating cover having an outer peripheral surface, and having apertures receiving said tab members with the said tab members extended through the said cover apertures and folded to lock the said cover in the cover receiving recess of the housing with the inner peripheral surface of the recess in engagement with the outer peripheral surface of the insulating cover to provide a seal to confine melted fuse material internally of said housing and provide test points via the said tabs to test said fuse.

2. The electrical blade fuse of claim 1 characterized in that the said cover includes a recess to receive the folded tabs such that the tabs reside within the profile of said housing.

3. The electrical blade fuse of claim 1 characterized in that the said housing material is formed tightly around the terminal portions to preclude a melted fuse material from shorting the said terminal members.

4. The electrical blade fuse of claim 1 characterized in that the said inner cavity is of a volume to readily accommodate melted fuse material without shorting the said terminal members.

5. The electrical blade fuse of claim 1 characterized in that the interior cavity includes beveled surfaces to facilitate direct insertion of the terminal element into said housing along a single axis.

6. The electrical blade fuse of claim 1 characterized in that the said terminal members include latches engaging housing apertures and operable to lock the said terminal elements in one sense against displacement in said housing through the engagement with said housing and said tabs operate to lock the said terminal through engagement with said cap in an opposite sense relative to said displacement and said housing.

* * * * *